United States Patent [19]

Koziol

[11] Patent Number: 4,790,666

[45] Date of Patent: Dec. 13, 1988

[54] LOW-SHEAR, CYCLONIC MIXING APPARATUS AND METHOD OF USING

[75] Inventor: Dale L. Koziol, Minneapolis, Minn.

[73] Assignee: Ecolab Inc., St. Paul, Minn.

[21] Appl. No.: 10,920

[22] Filed: Feb. 5, 1987

[51] Int. Cl.[4] ..... B01F 3/08

[52] U.S. Cl. ..... 366/165; 210/512.1

[58] Field of Search ..... 210/512.1, 512.2; 209/144, 211; 366/165, 184, 341, 348, 349

[56] References Cited

U.S. PATENT DOCUMENTS 3,754,655 8/1973 Troland ..... 210/512.1

4,280,902 7/1981 Jacobson et al. ..... 210/512.1

*Primary Examiner*—Frank Sever

*Attorney, Agent, or Firm*—Merchant, Gould, Smith, Edell, Welter & Schmidt

[57] ABSTRACT

A low-shear mixing apparatus comprising a cyclone separator and a cyclone mixer wherein underflow from the cyclone separator passes into the cyclone mixer and is combined therein with a downwardly spiraling vortex of a second component.

17 Claims, 2 Drawing Sheets

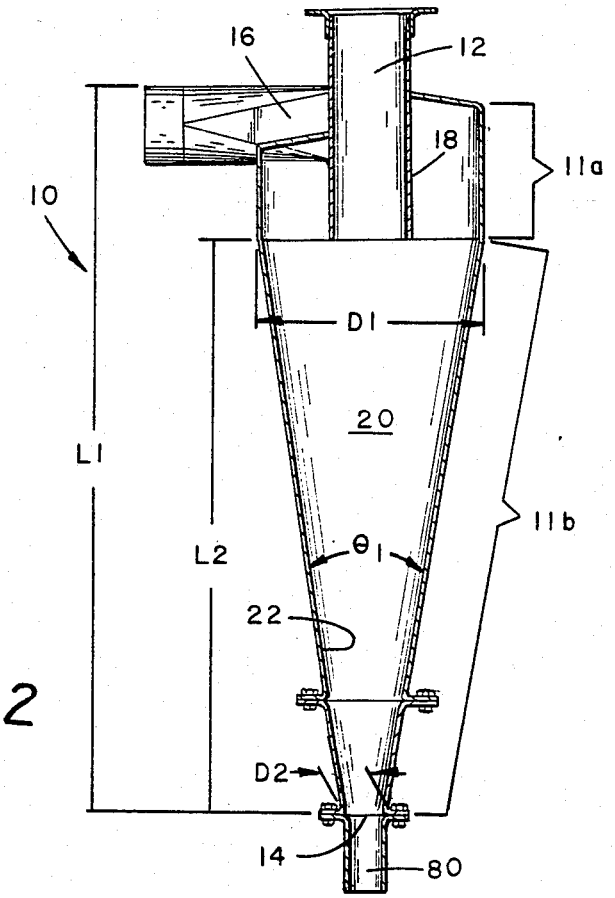
FIG. 2
FIG. 3
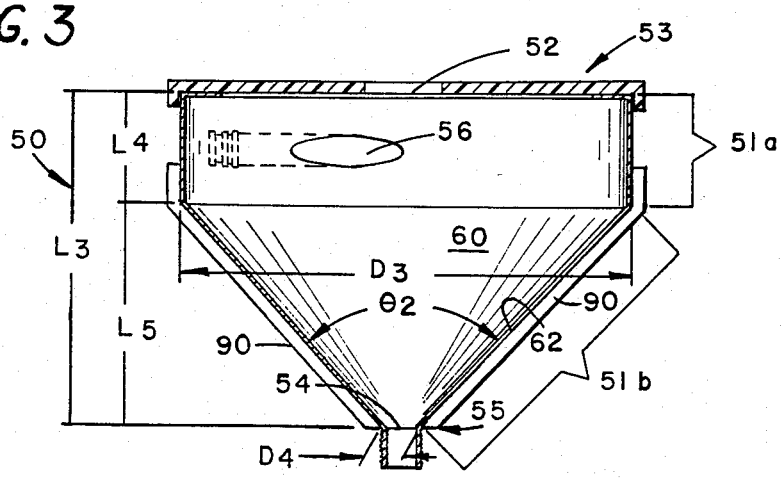

LOW-SHEAR, CYCLONIC MIXING APPARATUS AND METHOD OF USING

FIELD OF THE INVENTION

Broadly, the invention relates to mixing apparatuses. More specifically, the invention relates to mixing apparatuses capable of continuously mixing two or more liquid and/or solid components with minimal shear.

BACKGROUND OF THE INVENTION

The formation of a homogeneous mixture from two or more liquid and/or solid components is a common process step utilized at some point in almost every manufacturing process. Its wide-spread use has resulted in the development of a number of different types of mixing apparatuses including such types as axial-flow and radial-flow impeller mixers, shear-bar mixers, helical-blade mixers, double-arm kneading mixers, static mixers, roll mills, pug mills, single-screw and twin-screw extruders, and many others.

While many different types of mixing apparatuses have been developed to meet various processing needs, the search continues for additional types of mixing apparatuses to meet as yet unfulfilled processing needs.

Accordingly, a substantial need exists for a low-maintenance mixing apparatus capable of continuously forming homogeneous mixtures under low-shear conditions.

SUMMARY OF THE INVENTION

I have discovered an inexpensive, low-maintenance mixing apparatus capable of continuously mixing large quantities of two or more liquid and/or solid components under low-shear conditions. Further, the mixing apparatus can rapidly heat or cool each component immediately prior to mixing and/or the resultant mixture immediately after mixing.

In brief, the mixing apparatus comprises a cyclone separator and a cyclone mixer. The cyclone separator comprises a conical shaped vessel equipped with an overflow outlet port, an underflow outlet port, an inner conical cavity and a tangential inlet port for separating a first feed stream into a heavy or underflow portion which vortically passes out of the cyclone separator through the underflow outlet port and a light or overflow portion which vortically passes out of the cyclone separator through the overflow outlet port. The cyclone mixer comprises a funnel shaped vessel equipped with an underflow inlet orifice, an outlet orifice, an inner conical chamber, and a tangential inlet orifice for combining, under low-shear conditions, a second feed stream and the underflow portion from the cyclone separator.

In operation, the first feed stream is introduced into the cyclone separator through the tangential inlet port so as to create a downwardly spiraling vortex of the first feed stream within the inner conical cavity and then subjecting the first feed stream vortex to a pressure gradient which causes the first feed stream to separate into a light or overflow upwardly spiraling vortex and a heavy or underflow downwardly spiraling vortex. The second feed stream is introduced into the cyclone mixer through the tangential inlet orifice so as to create a downwardly spiraling vortex of the second feed stream within the inner conical chamber and the still vortically moving underflow portion from the cyclone separator added to the second feed stream vortex. The second feed stream and the underflow portion from the cyclone separator are intimately mixed, under low shear conditions, within the cyclone mixer before passing out of the cyclone mixer through the outlet orifice.

BRIEF DESCRIPTION OF THE DRAWINGS

FIG. 2 is a cross-sectional view of the cyclone separator portion of FIG. 1 taken generally along the line 2—2.

FIG. 3 is a cross-sectional view of the cyclone mixer portion of FIG. 1 taken generally along the line 3—3.

DETAILED DESCRIPTION OF THE INVENTION INCLUDING A BEST MODE

Figure 1:
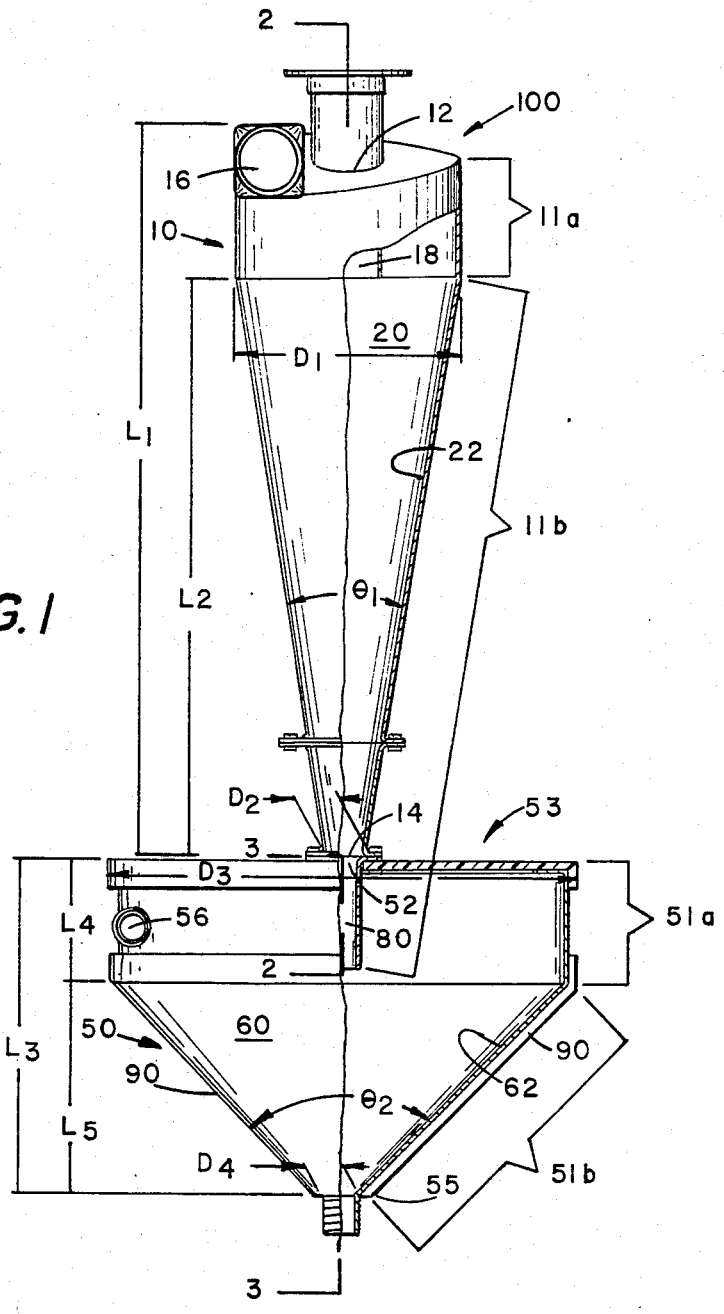
FIG. 1 is a front view of one embodiment of the present invention with portions thereof broken away.

I have discovered an inexpensive, low-maintenance mixing apparatus 100 capable of continuously mixing large quantities of two or more liquid and/or solid components under low-shear which comprises a cyclone separator 10 in communication with a cyclone mixer 50.

Cyclone Separator

Cyclone separators are a well defined group of devices which can separate a multi-component feed stream into a light or overflow fraction and a heavy or underflow fraction by subjecting the feed stream to centrifugal force and a pressure gradient. Generally, a cyclone separator 10 is an elongated, inverted, right circular frustum of a cone **11*b* having an outlet 12 at the top, an outlet 14 at the bottom, a tangential inlet 16 near the top and an outlet pipe 18 extending into the inner cavity 20 of the separator 10 from the top outlet 12 to prevent the feed stream from passing directly from the inlet 16 to the top outlet 12. Typically, the tangential inlet 16 enters the inner cavity 20 of the separator 10 through a top portion 11a of the separator 10** which defines a right circular cylinder.

In operation, a feed stream is introduced into the cyclone separator 10 through the inlet 16 whereupon it develops a rotating vortical motion. The vortex thus formed develops a centrifugal force of from about 5 to 2,500 Gs which acts to throw the heavier portion of the feed stream radially toward the side wall 22 of the cyclone separator 10. The feed stream follows a downward spiral adjacent the side wall 22 of the separator 10 until it approaches the bottom at which time the lighter portion of the feed stream separates from the heavier portion of the feed stream to form an inner vortex which moves upward, in a tight spiral, through the top outlet 12 of the cyclone separator 10. The heavier portion of the feed stream continues spiraling downward until it passes out of the cyclone separator 10 through the bottom outlet 14.

A detailed discussion of the design features and functioning of cyclone separators may be found in Perry and Chilton, *Chemical Engineers Handbook*, 5th Ed., pp. 20–81 through 20–87.

The particular dimensions of the cyclone separator 10 utilized in the present invention are not critical and may be custom selected for each application to achieve the desired flow rate, separation efficiency, etc the bottom of the cyclone separator 10 is imperforate except for outlet 14. bottom of the cyclone separator 10 is imperforate except for outlet 14.

For purposes of illustration, a typical cyclone separator 10 may have a 4 inch diameter overflow outlet port 12, a 4 inch diameter overflow outlet pipe 18 extending 8 inches into the inner cavity 20 of the cyclone separator 10, a 2 inch diameter underflow outlet port 14, an upper diameter $D_1$ of 12 inches, a lower diameter $D_2$ of 2 inches, a total length $L_1$ of 40 inches, a conical length $L_2$ of 30 inches, and an angle $Q_1$ defined by the side walls 22 of about 20°.

The cyclone separator 10 may be constructed of any sufficiently durable material capable of withstanding the temperature, pressure and abrasion encountered during the separation process including plastics such as urethane and polycarbonate; metals such as aluminum, steel, stainless steel and ferro-nickel alloys. Because it is durable, inexpensive, readily available and easily fabricated into the necessary shape, the preferred material of construction is carbon steel.

Cyclone Mixer

The cyclone mixer 50 is a funnel shaped vessel 51b having a longitudinal length $L_3$, a top 51 which defines an underflow inlet orifice 52 and an upper diameter $D_3$, a bottom 53 which defines an outlet orifice 54 and a lower diameter $D_4$, a side wall 73 which defines an inner chamber 60, and a tangential inlet orifice 56 near the top 51 for tangentially introducing a mixing feed stream into the inner chamber 60. Typically, the cyclone mixer 50 is constructed so that the tangential inlet 56 enters the inner chamber 60 of the mixer 50 through a top portion 51*a* of the mixer 50 which defines a right circular cylinder.

In operation, a feed stream is introduced into the cyclone mixer 50 through the tangential inlet orifice whereupon the mixing feed stream develops a vortical rotating motion. The vortex thus formed develops a centrifugal force which acts to throw the feed stream radially towards the side wall 62. The feed stream spirals downward adjacent the side wall 62 of the cyclone mixer 50 until it reaches the outlet orifice. Simultaneous with introduction of the mixing feed stream, underflow from the cyclone separator 10, still traveling in a downward vortex, enters the cyclone mixer 50 through the underflow inlet orifice 52. Due to the spiral motion of the underflow, the underflow is thrown radially towards the side wall 62 of the cyclone mixer 50 whereupon it contacts and mixes with the feed stream. The mixture when continues to spiral downward, adjacent the side wall 62, until it reaches the outlet orifice 54 whereupon it exits the cyclone mixer 50.

The cyclone mixer 50 is designed and operated to prevent any separation of components. Chief among the design factors preventing separation of components in the cyclone mixer 50 is the absence of a pressure gradient due to its open atmosphere design. Other factors which tend to prevent the separation of components in the cyclone mixer 50 are (i) a length $L_3$ to diameter $D_3$ ratio of less than about 1:1 and (ii) a tangential inlet orifice 56 diameter to outlet orifice 54 diameter ratio of less than about 1:1.

For purposes of illustration, a typical cyclone mixer 50 may have a 24 inch upper diameter $D_3$; a top 51 which is completely open to the atmosphere, a 2 inch diameter tangential inlet orifice 56, a 2 inch lower diameter $D_4$, a 2 inch outlet orifice 54, a total length $L_3$ of 18 inches, an upper cylindrical portion 51*a* which is 6 inches long ($L_4$), a conical portion 51*b* which is 10 inches long ($L_5$), and an angle $Q_2$ defined by the side walls 62 of about 90°.

Like the cyclone separator, the cyclone mixer may be constructed of any sufficiently durable material capable of withstanding the temperatures, pressures and abrasion encountered during the mixing process, including plastics such as urethane and polycarbonate; metals such as aluminum, steel, stainless steel and ferro-nickel alloys; and ceramics. Because it is durable, inexpensive, readily available and easily fabricated into the necessary shape, the preferred material of construction is carbon steel.

Underflow Outlet Nozzle

The mixing apparatus 100 may include a nozzle 80 for the cyclone separator's 10 underflow outlet port 14 which, when used, will delay release of underflow into the cyclone mixer 50. The longer the nozzle 80 the longer the delay and the shorter the contact time between the underflow and the mixing feed stream in the cyclone mixer 50.

Heating/Cooling Jacket

The cyclone mixer 50 may be equipped with a heating and/or cooling jacket 90 for controlling the temperature of the component feed streams or the mixture therein. Because the mixing feed stream and the mixture travel within the cyclone mixer 50 in a thin, sheet-like vortex against the side wall 62 of the cyclone mixer 50 they may be rapidly heated or cooled, allowing underflow and mixing feed stream to be rapidly combined even though it may be necessary to heat and/or cool the component feed streams or the resulting mixture before they combine or leave the cyclone mixer.

By regulating the feed stream flow rates and the size of the outlet orifice 54 it is possible to either (i) allow the mixture to exit the cyclone mixer 50 immediately upon reaching the bottom 55 of the cyclone mixer 50 or (ii) create a swirling pool of mixture at the bottom 55 of the cyclone mixer 50 in order to increase dwell time of the mixture in the cyclone mixer 50.

The mixing apparatus 100 is ideal for combining components such as aqueous sodium hydroxide and granular sodium tripolyphosphate which, when combined, generate a large amount of heat and when cooled harden to form a cast composition. The mixing apparatus 100 is capable of efficiently removing the excess heat generated by the mixture and allows the mixture to be quickly cast in a receptacle at a temperature just above that temperature at which the mixture solidifies.

The specification and Examples above are presented to aid in the complete, nonlimiting understanding of the invention. Since many variations and embodiments of the invention can be made without departing from the spirit and scope of the invention, the invention resides in the claims hereinafter appended.

I claim:

1. A low-shear mixing apparatus, comprising:

(a) a cyclone separator having (i) a top defining an overflow outlet port, (ii) an imperforate bottom defining an underflow outlet port, (iii) a sidewall defining an inner conical cavity, and (iv) a tangential inlet port; elements (i), (ii), (iii) and (iv) defining a means for separating a feed stream introduced into the inner conical cavity through the tangential inlet port into an underflow portion which passes out of the cyclone separator through the underflow outlet port and an overflow portion which passes out of the cyclone separator through the overflow outlet port; and (b) a cyclone mixer comprising a funnel shaped vessel having (I) a top defining an underflow inlet orifice in communication with the underflow outlet port of the cyclone separator, (II) a bottom defining an outlet orifice, (III) a sidewall defining an inner conical chamber, and (IV) a tangential inlet orifice; elements (I), (II), (III) and (IV) defining a means for combining and mixing, under low-shear conditions, a mixing feed stream vortically introduced into the inner conical chamber through the tangential inlet orifice and the underflow portion from the cyclone separator vortically introduced into the cyclone mixer through the underflow inlet orifice; the mixing feed stream and underflow portion mixing together as they vortically travel together in the cyclone mixer.

2. The mixing apparatus of claim 1 further comprising a nozzle for the underflow outlet port of the cyclone separator for delaying introduction of the underflow portion into the inner conical chamber of the cyclone mixer.

3. The mixing apparatus of claim 2 wherein the cyclone mixer has a longitudinal length and the nozzle has a longitudinal length of about 5 to 50% of the longitudinal length of the cyclone mixer.

4. The mixing apparatus of claim 1 wherein the underflow portion is introduced into the cyclone mixer in the form of a right circular cylinder.

5. The mixing apparatus of claim 1 wherein the underflow portion is introduced into the cyclone mixer in the form of a right circular cone.

6. The mixing apparatus of claim 1 wherein the angle defined by the cyclone mixer side wall is about 20° to 150° and a ratio of the cyclone mixer's upper diameter to lower diameter is about 3:1 to 50:1.

7. The mixing apparatus of claim 1 wherein the angle defined by the cyclone mixer side wall is about 60° to 120° and a ratio of the cyclone mixer's upper diameter to lower diameter is about 10:1 to 20:1.

8. The mixing apparatus of claim 1 wherein the top of the cyclone mixer defines the underflow inlet orifice and is completely open to the atmosphere.

9. The mixing apparatus of claim 1 wherein the cyclone separator and the cyclone mixer are designed and aligned such that the overflow outlet port, underflow outlet port, underflow inlet orifice an outlet orifice are axially aligned.

10. The mixing apparatus of claim 1 wherein the cyclone separator and the cyclone mixer each have a cylindrical portion and a conical portion and the conical portion of each defines a frustum of a right circular cone.

11. The mixing apparatus of claim 1 further comprising a temperature regulating means surrounding the cyclone mixer for controlling the temperature of the mixture formed therein.

12. The mixing apparatus of claim 1 wherein the tangential inlet orifice of the cyclone mixer is in the top one-third portion thereof.

13. A method of mixing two components comprising the steps of:

(a) providing a cyclone separator having (i) a top defining an overflow outlet port, (ii) an imperforate bottom defining an underflow outlet port, (iii) a sidewall defining an inner conical cavity, and (iv) a tangential inlet port;

(b) introducing a first feed stream into the cyclone separator through the inlet port;

(c) separating the first feed stream into a vortically rotating overflow portion and a vortically rotating underflow portion in the cyclone separator;

(d) tangentially introducing a second feed stream into a funnel shaped vessel so as to develop a spiralling vortex of the second feed stream;

(e) combining the vortically rotating underflow portion of the first feed steam and the spiralling vortex of second feed stream in the funnel shaped vessel such that the underflow portion of the first feed stream and the second feed stream combine to form a substantially homogeneous mixture as they vortically travel together in the vessel.

14. The method of claim 13 wherein the underflow portion is combined with the second feed stream substantially immediately after separation of the underflow portion from the overflow portion.

15. The method of claim 14 wherein the mixture forms a swirling pool of about 0.5 to 10 inches deep at the bottom of the vessel before passing through the vessels outlet port.

16. The method of claim 13 further comprising the step of actively cooling the mixture while it is in the funnel shaped vessel.

17. The method of claim 13 further comprising the step of actively heating the mixture while it is in the funnel shaped vessel.

* * * * *